United States Patent [19]

Haag

[11] 4,262,855

[45] Apr. 21, 1981

[54] WEB-SPLICING APPARATUS

[75] Inventor: David R. Haag, Matawan, N.J.

[73] Assignee: Champion-Edison, Inc., Edison, N.J.

[21] Appl. No.: 139,909

[22] Filed: Apr. 14, 1980

[51] Int. Cl.[3] ..... B65H 19/18

[52] U.S. Cl. ..... 242/58.1; 156/504; 226/104

[58] Field of Search ..... 242/58.1, 58.2, 58.3, 242/58.4, 58.5, 58.6, 56 R; 226/104, 105, 106, 107; 156/504, 505, 506

[56] References Cited

U.S. PATENT DOCUMENTS

| | | | |
|---|---|---|---|
| 3,645,463 | 2/1972 | Helm | 242/58.1 |
| 3,891,158 | 6/1975 | Shearon | 242/58.1 |
| 3,918,655 | 11/1975 | Hillner | 156/504 X |
| 4,233,104 | 11/1980 | Fujishima | 156/504 |

*Primary Examiner*—Edward J. McCarthy
*Attorney, Agent, or Firm*—Haseltine and Lake

[57] ABSTRACT

An improved web-splicing apparatus for automatically splicing the beginning of one roll of papers onto the approximate end of a second roll of paper without discontinuing the flow of paper to a utilizing device. The apparatus is provided with speed sensing means, electrical eye, and control means. The speed sensing means get activated at a predetermined speed of the exhausting roll, which in turn activates electrical eye which energizes the control means to activate the braking device to stop the web at the same spot.

3 Claims, 4 Drawing Figures

WEB-SPLICING APPARATUS

BACKGROUND OF THE INVENTION

In U.S. Pat. Nos. 3,645,463 and 3,918,655, assigned to the assignee of the present invention, there is described an apparatus for automatically splicing the beginning of one roll of paper or the like onto the approximate end of a second roll of paper of like material without discontinuing the flow of paper to utilizing device.

The apparatus described in the U.S. Pat. No. 3,645,463 includes a support stand having means for supporting first and second rolls of paper in rotatable relationship therewith. Also carried on the support stand is a festooner arrangement including at least one set of displaceable rollers for establishing an elongated path of travel for paper of the exhausting roll, moving to the apparatus, and for allowing the utilizing device to feed upon the paper carried by the festooner when the second, exhausting roll of paper has stopped rotating to initiate the automatic splicing operation.

Once the exhausting roll of paper has stopped rotating and during the time that the displaceable rollers of the festooner are continually shortening the aforementioned elongated path of travel, such that the utilizing device still has a supply of paper upon which to feed; the clamping, severing and splicing assembly of the patented invention performs three functions. First, the clamping mechanism thereof clamps the paper of the exhausting roll between itself and a backing plate positioned on the opposite side of the path of travel of the paper. Second, and virtually immediately after the clamping operation, the severing portion of the clamping, severing and splicing assembly severs the exhausting roll of paper at a location beneath the position at which the trailing end of the exhausting roll is maintained by the clamp. Third, and virtually simultaneously with the aforedescribed severing, the splicing portion of the clamping, severing and splicing assembly joins the previously treated beginning end of a new roll of paper with the severed end of the exhausted roll of paper. Finally, once the clamping, severing and splicing assembly is reset, such that the clamping portion thereof is released from the trailing end of the exhausted roll of paper, the new roll of paper will begin to flow through the festooner rollers and onto the utilizing device.

As disclosed in U.S. Pat. No. 3,918,655, it has been found desirable to accelerate the new roll of paper to help it reach the speed of the utilizing device and thereby avoid the possibility of the paper being severed when the festooner supply is used up. To effectuate the acceleration of the new roll of paper, a motor is employed and controlled by a timer which energizes the motor for a predetermined period of time, selected in accordance with the weight of the roll of paper. A tension responsive mechanism is provided to sense the tension in the paper being dispensed from the new roll of paper and through the use of a variable potentiometer, to apply control signals to a braking mechanism associated with the shaft upon which the new roll of paper is supported. As the new roll of paper accelerates and its "pay out" of paper approaches the "take-up" of paper by the utilizing device, such equilibrium is sensed by the tension responsive mechanism so as to generate the necessary control signals to energize the braking mechanism and slow down the new roll of paper. Of course, any slow down of the new roll of paper will cause the tension responsive mechanism to generate appropriate control signals to deactivate the braking mechanism to allow the new roll of paper to speed up once again. In effect, the system functions as a servomechanism, allowing the new roll of paper to properly accelerate and decelerate in accordance with the speed of take-up of the utilizing device.

However, this apparatus did not eliminate the waste which occurs when the printed rolls are not spliced in the register. Typically, the user of printed material must either stop his production line to splice printed rolls together in register or he must splice out of register and scrap all production until the printing again lines up in proper order with his product.

Accordingly, it may be appreciated that a need for a fast and accurate web-splicing apparatus has long existed in the prior art.

SUMMARY OF THE INVENTION

The present invention is directed to improvements in the web-splicing apparatus disclosed in the aforementioned U.S. Pat. Nos. 3,645,463 and 3,918,655. The web-splicing apparatus is provided with speed-sensing means, electrical sensing means and control means. The speed-sensing means are mounted on a common support bar of the apparatus. The sensing means are activated at a predetermined speed of the exhausting roll. The electrical sensing means known as electrical eye is actuated upon receiving a signal from the speed sensing means and which in turn activates a relay of the control means and thus the brake plunger on the splicer assembly immediately stops the web repeatedly at the same spot. Once the web is stopped, the splicer works exactly as described in U.S. Pat. No. 3,918,655.

It is an object of the present invention to provide an accurate and efficient web-splicing apparatus.

It is another object to provide elimination of waste when printed rolls are not spliced in register.

DETAILED DESCRIPTION OF THE INVENTION

Figure 1:
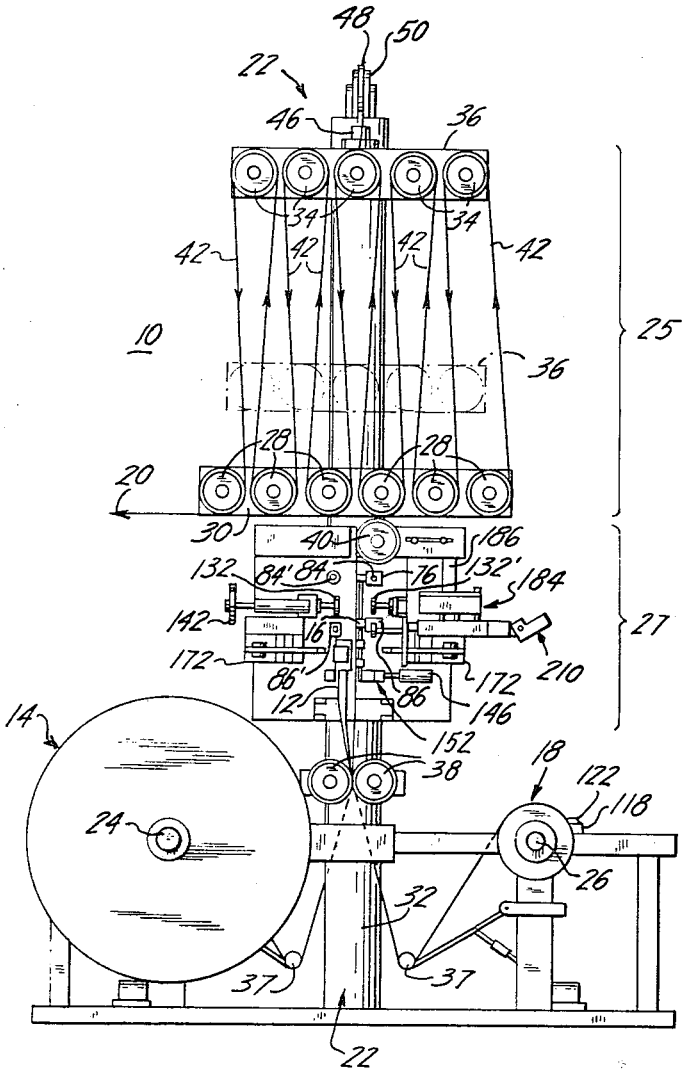
FIG. 1 PRIOR ART
FIG. 1 is a front view of the automatic splicing apparatus of the prior art.

Turning to the figures, wherein like numerals are used to designate like elements, and with specific reference to FIG. 1, there is shown the automatic splicing apparatus 10 of the prior art as disclosed and claimed in U.S. Pat. Nos. 3,645,463 and 3,918,655 assigned to the assignee of the present invention, and, accordingly, the subject matter thereof is specifically incorporated herein by specific reference thereto. However, for purposes of better understanding the present invention, a short review of the operation of the apparatus is presented herein.

Thus, with reference to FIG. 1, there is shown the automatic splicing apparatus 10 by which the previously treated beginning end 12 of the new roll of paper 14 may be quickly and automatically joined to the approximate end 16 of a virtually exhausted roll 18 of paper or like material without discontinuing the flow of paper to a utilizing device (not shown) but whose location is depicted by the arrowhead 20 associated with the flow of paper through the apparatus 10. The designation "approximate" end 16 of the exhausted roll of paper 18 is intended to denote the fact that the beginning end 12 of the new roll of paper 14 will be joined to the paper of the exhausted roll 18, not at its actual end thereof, but at a point 16 substantially near the end of the paper on the roll 18.

Broadly speaking, the apparatus 10 includes a support stand 22 provided at its lower extremity with a pair of outstanding bearing axles 24 and 26, respectively, which carry the rolls of paper 14 and 18 in a manner to be further described. At its opposite extremity, the support stand 22 carries a festooner arrangement broadly designated 25, while at an intermediate location, the support stand 22 carries clamping, severing and splicing means broadly designated 27.

The festooner arrangement 25 includes a first set of rollers 28 rotatably carried by a common support bar 30 rigidly secured to a central post-like portion 32 of the support stand 22. The festooner 25 further includes a second set of rollers 34 rotatably carried by a common bar 36 slideably displaceable along the upright post portion 32 of the support 22. Although not illustrated in detail, it might be noted that the common bar 36 may be slideably mounted along the central post portion 32 of the support stand 22 by any convenient mounting means, such as an enlarged collar circumventing the post portion 32 or by being appropriately retained in a retaining channel or guide provided along the forward surface of the post portion 32. Regardless of the mounting arrangement being utilized, the second set of rollers carried by the common bar 36 must be displaceable relative to the first set of rollers 28, as suggested by the phantom showing 36 prime in FIG. 1.

Thus, it will be appreciated that the normal flow of paper through the apparatus 10 is from the exhausting roll 18, around a pair of tension responsive rollers 37, forming a part of the instant invention, and to be described in greater detail, through a pair of positioning rollers 38, through the clamping, severing and splicing apparatus 27, around the freely rotating directional roller 40, then around the rollers 28 and 34 in the manner depicted by arrowheads 42; and finally to the utilization device (not shown) whose location is depicted by the arrowhead 20. It can thus be appreciated that the tortuous path defined by the rollers 28 and 34 of the festooner arrangement 25 establishes an elongated path of travel for the paper and in so doing makes a considerable amount of paper available above the clamping, severing and splicing apparatus 27. Thus, when the roller 18 has been just about exhausted such that it is necessary to halt its rotation and initiate the changeover operation; by virtue of the downward displacement of the second set of rollers 34, this amount of paper carried in the festooner will become available for continuous supply to the utilizing device. During this displacement, the clamping, severing and splicing assembly 27 will join the beginning end 12 of the roll 14 to the approximate end 16 of the exhausted roll of paper 18. The manner in which this is effected is, as noted above, completely set out in detail in the aforementioned U.S. Pat. No. 3,645,463, and will not be repeated in detail herein. Sufficient to note, that once the clamping, severing and splicing mechanism has been operated to join the beginning end of the first roll to the approximate end of the exhausted roll, the mechanism is reset and the utilizing device begins to feed on the paper being supplied by the new roll without any interruption having taken place during the changeover.

Figure 2:
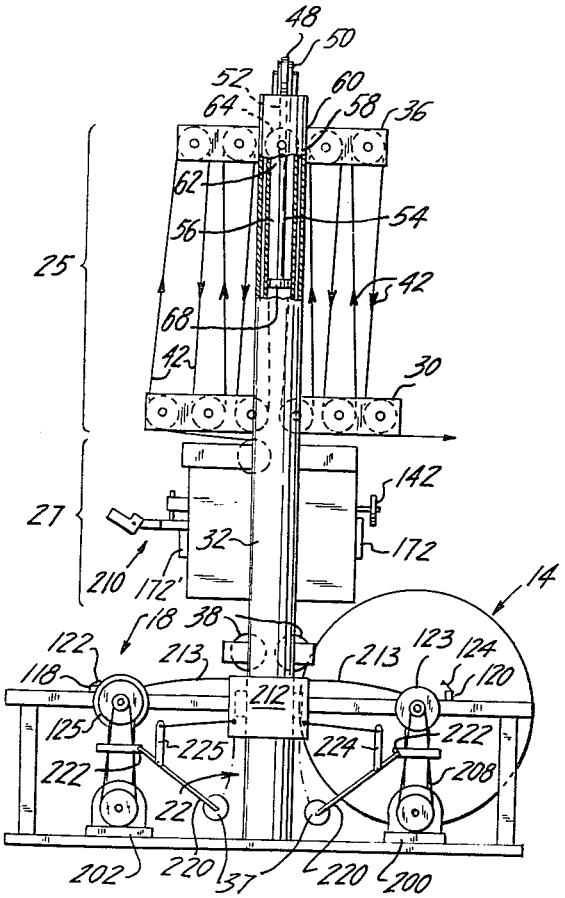
FIG. 2 PRIOR ART
FIG. 2 is a rear view of the apparatus of FIG. 1.
Figure 3:
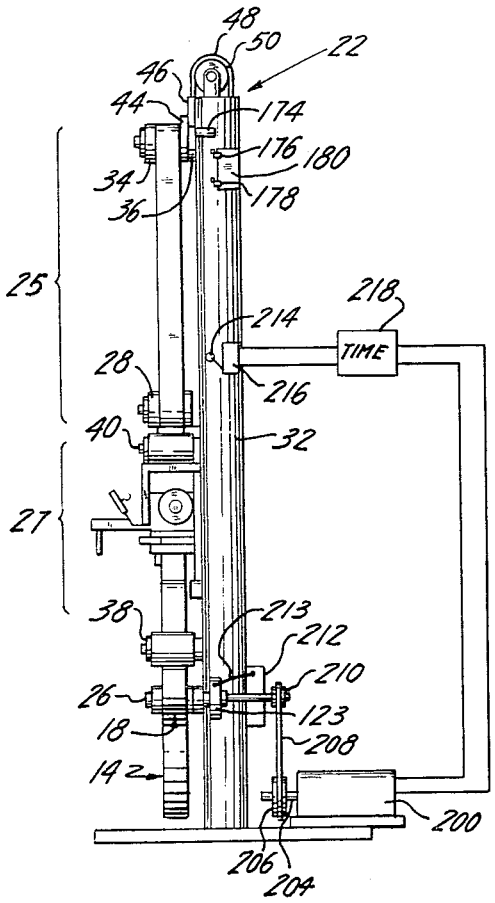
FIG. 3 PRIOR ART
FIG. 3 is an end view of the apparatus of FIG. 1.

With respect to the festooner arrangement 25, the upper displaceable bar 36 thereof has connected thereto, at a point generally designated 44 in FIG. 3, one end 46 of a chain or other suitable connecting member 48 which passes over a guide pulley 50, and into the hollowed-out central portion 32 of the strand 22 where its opposite end 52 (see FIG. 2) is connected to one end of a piston 54 which resides within a cylinder 56. The cylinder 56 includes an inlet port 58 provided with a conventional one-way check valve 60 and an outlet port 62 similarly provided with a conventional one-way check valve 64.

In operation, compressed air is supplied from a source broadly designated 66 in the aforementioned U.S. Pat. No. 3,645,463 through the inlet port 58 and against the enlarged piston head 68 of the piston 54. The pressure is maintained at a sufficient magnitude to just counterbalance the upward force on the piston 54 generated by the weight of the common bar 36 with the rollers 34 thereon and the tension force downwardly applied to the common bar 36 by virtue of the pull applied by the utilizing device on the paper passing through the apparatus. It will be appreciated that the one-way check valve 60 permits the entry of air under pressure into the cylinder 56 but prevents a reverse flow, while the one-way check valve 64 performs a similar function with respect to the exhausting of air from the cylinder 56 and, in addition, is constructed to permit build-up of sufficient counterbalancing air pressure against the piston head 68. Alternatively, valve 64 may be a manually controllable valve which can be pre set to exhaust upon the build-up of predetermined pressures within the cylinder 56 as a function of the speed of operation of the utilizing device.

Thus, during normal operation of the apparatus 10, that is, with the paper from roll 18 passing therethrough, the displaceable roll 34 will be maintained in the solid line position illustrated in FIG. 1. However, when the roll of paper 18 is virtually exhausted, such that it is necessary to halt rotation to initiate a changeover operation, there is a substantially greater downward force applied on the rollers 34. This increased downward force is, of course, generated by virtue of the fact that the exhausting roll of paper 18 has now stopped rotating, while the pull on the paper passing through the festooner arrangement 25 remains substantially the same. As a result, the upward force as applied to the piston 54 (FIG. 2) exceeds the counterbalancing force applied by the pressure from the source 66 whereby the piston 54 begins to rise (and the cylinder 56 is exhausted through the valve 64 and exit port 62). In this manner, as the utilizing device continues to pull on the paper carried by the festooner, the displaceable roller 34 are free to approach stationary rollers 28. It is during this downward displacement of the rollers 34, that the extra length of paper which was established by the tortuous pass of the rollers 28 and 36 becomes available for feeding the utilizing device while the changeover operation takes place.

To initiate the above-described process, there is provided on the support stand 22 adjacent the axles 24 and 26, at a predetermined diametric distance therefrom, a pair of sensing switches 118 and 120 (see FIG. 2). Each of the switches includes a sensing finger 122 and 124, respectively, which is normally biased to engage the rear surface of the roll of paper positioned therebefore.

Thus, when the roll of paper 18 is virtually exhausted, and its diameter becomes sufficiently small to no longer restrain the sensing finger 122, the normally open circuit established thereby (not shown) will close to energize appropriate braking means (123 or 125, respectively) to halt the rotation of the roll 18. The braking means 123 and 125 may be conventional electrically operated clutch-brake mechanisms associated with the bearing axles or support shafts 24 and 26 which carry the rolls of paper 14 and 18. In any event, when the sensing finger 124 is released, a circuit is made to apply in electrical signal to the brake 123 to halt the rotation of the roll 18. When the roll 18 is halted; the continued pull indicated by the arrowhead 20 will, with the "permission" of the exhausting cylinder 56 or 52, begin to move the rollers 34 toward the rollers 28, thereby providing a continuous flow of paper to the utilizing device starting the changeover operation in which the clamping, severing and splicing apparatus 27 operates in the manner described in the aforementioned U.S. Pat. No. 3,645,463.

After the operation of the clamping, severing and splicing apparatus, the entire mechanism thereof is reset, such that the trailing end of the old roll of paper and the beginning end of the new roll of paper spliced thereto, can continue flowing through the apparatus, it being appreciated that with paper flowing through the apparatus once again, the net downward force on the displaceable rollers 34 is reduced such that the common bar, under the influence of the fluid in the cylinder 56 of FIG. 2, will slowly return to its solid line position of FIG. 1.

As explained in greater detail in the aforementioned U.S. Pat. No. 3,645,463, to control in proper sequence, the various mechanisms, there is provided on the displaceable common bar 36 (see FIG. 3) an extending actuating finger 174 which will sequentially engage microswitches 176 and 178 carried by a stationary block 180 as the displaceable bar 136 moves from the solid line of FIG. 1 toward its phantom showing 36 prime. As described in the aforementioned patent, the closing of microswitch 176 by actuating finger 174 initiates the operation of the clamping, severing and splicing mechanism 27, while subsequently, when the finger 174 closes the microswitch 178, the clamping, severing and splicing mechanism 27 is reset to allow the new supply of paper to continue to feed through the apparatus.

Briefly summarizing the operation of the aforementioned patent, let it be assumed that the roll 18 of FIG. 1 is becoming exhausted such that it is desired to introduce a new roll of paper 14 without discontinuing the flow of paper to the utilizing device. When the exhausting roll of paper 18 dwindles down to a diameter less than the diametric location of the microswitch 118, the sensing finger 122 thereof is freed to establish the necessary circuit to energize the braking device 125 associated with the shaft 26 carrying the roll 18 to halt the rotation of the roll of paper 18. Once the rotation of the roll 18 is halted, the continued pull of the utilizing device on the paper exerts a substantially greater downward force on the rollers 34, whereby the common bar 36 begins its downward displacement toward the stationary roller 28. During such downward displacement, and while the changeover operation takes place, the additional paper carried by the festooner 25 now becomes available for utilization.

As the common bar 36 descends, with reference to FIG. 3, the extending finger 174 initially contacts the microswitch 176 to activate the clamping, severing and splicing apparatus 27 described in the aforementioned patent, a clamp 132 is actuated to grasp the approximate end 16 of the exhausting roll of paper; thereafter, the exhausting roll of paper 18 is severed, and, thereafter, the beginning end of the roll 14 is spliced to the end of the exhausting roll.

Finally, when the splicing completes, the extending actuating finger 174 shown in FIG. 3 reaches the second microswitch 178 carried by the block 180 to close the necessary circuit to reset the clamping, severing and splicing mechanism (which includes withdrawing of the clamp 132) such that the trailing end of the old roll of paper and the beginning end of the new roll of paper spliced thereto can continue flowing through the apparatus. Of course, since the new roll of paper 14 is not yet up to speed, there will still remain a net relative force in the direction of location 20 which will have the effect of continuing to pull the displaceable rollers 34 downwardly toward the stationary rollers 28.

As explained in U.S. Pat. No. 3,918,655, means are provided to actively accelerate the rotation of the new roll of paper 14 and then to regulate same in accordance with speed of the take-up of the utilizing device. To effect such operation, and with reference to FIG. 2, there is provided electric motors 200 and 202 associated with each of the rolls 14 and 18, respectively. Thus, with respect to FIG. 3, output shaft 204 of motor 200 carries a pulley 206 which is connected through V-belt 208 to pulley 210 on the rear of the support shaft 26 which carries the roll of paper 14. As noted previously, electrically operated brake 123 is situated intermediate the ends of the shaft 26 and is operated in accordance with electrical signals applied thereto from the variable potentiometer 212 to be described in greater detail. The motor 200 is energized when the finger 174 traveling with the displaceable rollers 34 closes microswitch 214 provided on a block 216 secured to the post 32. Closing of the microswitch 214 energizes a timer 218 to energize the motor 200 for a period of time in accordance with the setting applied to the timer 218. It will be appreciated that the timer is set in accordance with the weight of the roll of paper 14. Thus, the heavier the roll of paper 14, the longer the motor 200 must be energized in order to accelerate the roll 14. The timer 218 can be varied accordingly.

Assuming that after the clamping, severing and splicing mechanism has been reset by virtue of the finger 174 passing the microswitch 178, continued downward displacement of the rollers 34 causes the finger 174 to engage the microswitch 214 (FIG. 3). When microswitch 214 is closed, the timer 218 is energized for a predetermined length of time (which was preset in accordance with the weight of the roll 14) to energize the motor 200, the output of which through the V-belt 208 and pulley 210 causes the shaft 26 and the roll 14 carried thereby to accelerate. As the roll 14 accelerates, they pay-out of the paper thereon begins to approach the take-up speed of the utilizing device such that there is less tension in the paper being pulled and, in fact, the paper begins to slacken. As the paper traveling through the apparatus slackens, the roller bearing arm 220, under the influence of gravity, rotates counterclockwise downwardly about its pivotal connection 222 which motion is transmitted by mechanical linkage 224 to the variable pot 212 which applies appropriate braking signal via line 213 to the brake 123. Brake 123 then slows down the rotation of shaft 226 and the roll of paper 14 carried thereby to thereby prevent any over-acceleration of the roll 14. Of course, as the roll 14 slows down, the tension in the paper traveling through the apparatus increases and begins to pull the arm 220 upward and clockwise around its pivotal connection 222. Again, such movement is transmitted by the mechanical linkage 224 to the variable pot 212 to lessen the braking signal applied via the line 213 to the brake 123. Accordingly, shaft 26 and roll 14 is free to "catch up" with the utilizing device. The net result of the aforedescribed servosystem is to continually allow the roll of paper 14 to rotate in accordance with the takeup of the utilizing device.

Figure 4:
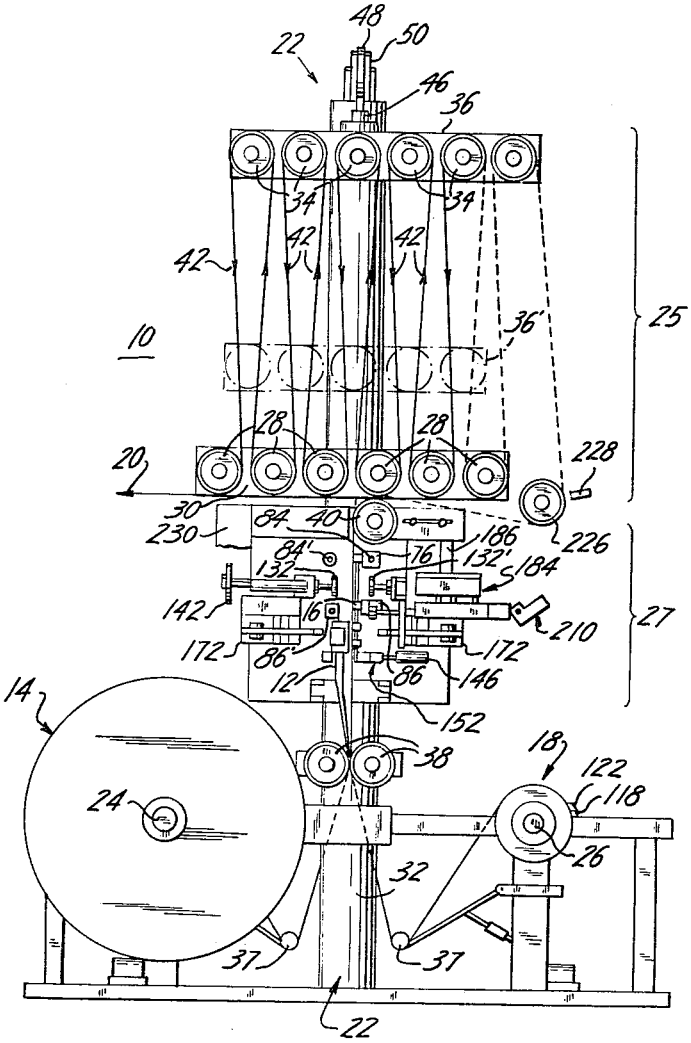
FIG. 4 is a front view of the automatic splicing apparatus of the present invention.

In accordance with the present invention, means are provided to splice accurately printed rolls of material together in register, i.e., printing lines up with printing on the next roll. As shown in FIG. 4, speed sensing means 226 are mounted on a common support bar slidably displaceable along an upright portion of the support stand 30, along with the first set of rollers 28 to respond to a predetermined speed (for an example, approximately 100 fpm) of the exhausting roll of paper 18. The speed sensing means 226 is a regular speed sensing switch as described hereinbefore. Further, electrical sensing means, more particularly, an electrical eye, having a photo sensing switch 228 disposed in line with the speed sensing switch 226 is activated upon a signal received from the speed sensing switch 226. This, in turn, activates control means 230. The control means 230 comprises a two-way relay unit which sends a signal to energize appropriate braking means (123 or 125 respectively as shown in FIG. 2) to halt the rotation of the roll 18. As explained hereinbefore, the braking means 123 and 125 may be conventional electrically operated clutch-brake mechanisms associated with the bearing axles or support shafts 24 and 26 which carry the rolls of paper. This immediately stops the web repeatedly at the same spot. The above-described mechanism helps to make certain that electrical sensing means 228 monitors the web moving at the same speed each time to increase accuracy of the register of the splice. Once the web is stopped, the clamping, severing and splicing apparatus 27 operates in the manner described in the aforementioned U.S. Pat. No. 3,918,655.

Although this invention has been described with respect to its preferred embodiments, it should be understood that many variations and modifications will now be obvious to those skilled in the art, and it is preferred, therefore, that the scope of the invention be limited, not by the specific disclosure herein, only by the appended claims.

What is claimed is:

1. An improved apparatus for automatically splicing the beginning of one roll of paper or the like onto the approximate end of a second roll of paper or the like without discontinuing the flow of paper to a utilizing device, of the type having a support stand; a pair of support shaft means for carrying a first roll of paper and a second exhausting roll of paper; festooner means; braking means; clamping, severing and splicing means; operating means; and switching means, wherein the improvement comprises:

(a) speed sensing means mounted on a common support bar slidably displaceable along an upright portion of the support stand, said speed sensing means being responsive to a predetermined speed of the second exhausting roll of paper;

(b) electrical sensing means disposed in line with said speed sensing means, said electrical sensing means being activated upon an actuation of said speed sensing means; and (c) control means responsive to said electrical sensing means for initiating an operation of the braking means.

2. The apparatus as recited in claim 1, in which the electrical sensing means comprises an electrical eye having a photosensing switch.

3. The apparatus as recited in claim 1, in which the control means comprises a relay unit.

* * * * *